US007526814B2

(12) United States Patent
Silver

(10) Patent No.: US 7,526,814 B2
(45) Date of Patent: May 5, 2009

(54) POT HOLDER/MITT

(76) Inventor: Scott H. Silver, 18 Cushing Ave., Annapolis, MD (US) 21403

( * ) Notice: Subject to any disclaimer, the term of this patent is extended or adjusted under 35 U.S.C. 154(b) by 212 days.

(21) Appl. No.: 11/461,177

(22) Filed: Jul. 31, 2006

(65) Prior Publication Data

US 2008/0022435 A1 Jan. 31, 2008

(51) Int. Cl.
*A41D 13/08* (2006.01)

(52) U.S. Cl. ..... 2/16; 2/158

(58) Field of Classification Search ..... 2/158, 2/16, 20, 161.6, 167, 169; 15/227
See application file for complete search history.

(56) References Cited

U.S. PATENT DOCUMENTS 1,351,311 A * 8/1920 Virneburg ..... 401/8
1,521,935 A * 1/1925 Elwell ..... 15/227
1,972,197 A * 9/1934 McCann ..... 2/20
2,006,708 A * 7/1935 Benedict ..... 401/201
4,071,921 A 2/1978 Jury
4,726,400 A * 2/1988 Heiman ..... 139/396
5,486,500 A 1/1996 Kaufman
6,112,372 A 9/2000 Zhou et al.
6,247,505 B1 6/2001 Worman
6,305,023 B1 * 10/2001 Barkes ..... 2/20
6,684,460 B2 * 2/2004 Cuff ..... 16/435
6,898,802 B1 * 5/2005 Suarkeo ..... 2/20
7,124,446 B2 * 10/2006 Demay et al. ..... 2/16
7,213,313 B2 * 5/2007 Nohara ..... 28/159
2004/0237235 A1 * 12/2004 Visioli et al. ..... 15/104.94

* cited by examiner

*Primary Examiner*—Gary L Welch
*Assistant Examiner*—Sally C Cline
(74) *Attorney, Agent, or Firm*—Lawrence E. Laubscher, Jr.

(57) ABSTRACT

A pot holder/mitt is characterized by formation from a single layer of Z-folded fabric which is formed from hydrophobic and hydrophilic materials which extend from opposite surfaces of the fabric. The front surface of the holder/mitt is formed of hydrophobic material and is adapted to receive a decorative pattern which is printed thereon. The rear surface of the holder mitt is formed of hydrophilic material. The inner surfaces of the pocket are also formed of hydrophilic material for comfort and heat protection for the hand of the user.

6 Claims, 2 Drawing Sheets

POT HOLDER/MITT

BACKGROUND OF THE INVENTION

Pot holders and pocket mitts are used as both hand protection and coordinate decoration in the kitchen. Heretofore, pot holders and mitts were either made from woven or knitted fabrics of separate component parts which are cut to size and then either quilted of sewn or joined together to produce a multilayer sandwich of layers having heat or flame resistance and hand protection from one side of the holder or mitt and a decorative design element on the other side for home fashion and coordination with other items in a printed ensemble.

The present invention relates to a unique pot holder/mitt which is formed of a single piece of fabric which when folded and joined provides an article with two distinct surfaces affording both utility and decorative functions.

BRIEF DESCRIPTION OF THE PRIOR ART

Fabrics made with different materials on opposite sides are well known in the patented prior art as evidenced by the U.S. Pat. No. 6,247,505 to Worman. Such fabrics are used to produce towels and bathrobes where it is desirable to have a moisture absorbent material, such as microfiber, on one surface of the fabric and cotton fabric on the other.

It is also known to produce a fabric of different materials on opposite sides thereof wherein one side is printed with a decorative component as evidenced by the U.S. Pat. No. 5,486,500 to Kaufman. The fabric is used to produce a towel wherein one face is a print receiving face formed primarily of non-absorbent material and the opposite face is an absorbent face formed of absorbent material.

Current methodology used to manufacture decorative kitchen textiles such as dish towels, pot holders and mitts use a silk screen process which produces a relatively poor and limited color range and lack of photographic image detail which does not hold up to laundering. A solid color binding of cotton or poly/cotton material is sewn around the perimeter edges to bind or attach the layers of the pot holders or mitt together during manufacture thereof. Unfortunately, this solid color binding detracts and interferes with the printed image.

The present invention was developed in order to overcome these and other drawbacks of the prior fabrics and products by providing a pot holder/mitt which is formed from a single layer of fabric incorporating different materials on opposite sides which when folded and stitched provides a holder/mitt with outer surfaces providing different functions.

SUMMARY OF THE INVENTION

According to the invention, a pot holder/mitt includes a layer of fabric having a hydrophobic material on one side and a hydrophilic material on the opposite side which is folded into a Z-shaped configuration to define first, second and third portions which are bound with a fabric binding sewn about the perimeter to define at least one pocket between the folded portions. The first portion has a first surface of hydrophobic material and a second surface of hydrophilic material, the second portion has a third surface of hydrophilic material and a fourth surface of hydrophobic material, and the third portion has a fifth surface of hydrophobic material and a sixth surface hydrophilic material. The first and sixth surfaces define outer surfaces of the holder/mitt, the second and third surfaces are arranged opposite one another and the fourth and fifth surfaces are arranged opposite one another.

In a preferred embodiment, a layer of adhesive is arranged between the fourth and fifth surfaces to join them together so that a pocket is defined only between the second and third surfaces. In addition, the first surface bears a decorative pattern which is applied thereto by vapor transfer dye sublimation printing. The hydrophobic material preferably comprises a polyester, nylon, acrylic or microfiber yarn and the hydrophilic material preferably comprises a cellulosic and cotton yarn.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
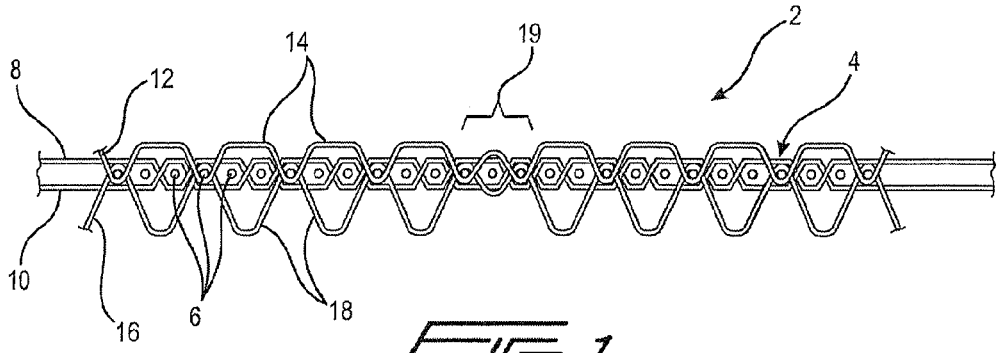
FIG. 1 is a sectional view of a fabric used to manufacture the pot holder/mitt according to the invention.

Referring first to FIG. 1, there is shown a longitudinal cross section of the fabric 2 according to the invention. The fabric has a unitary construction formed in a single sheet which includes a support web 4 formed by a plurality of picks 6 across which two warp ends 8, 10 are woven. In the drawing, the warp ends are woven around every third pick, although alternate weaving patterns may be used as is known in the art to form the web. The array of picks and warp ends defines the web 4 which has top and bottom surfaces.

Figure 2:
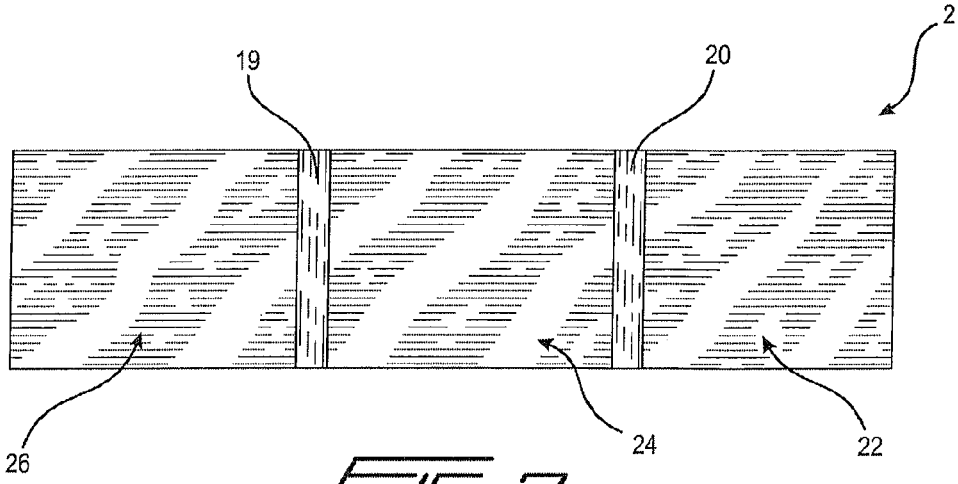
FIG. 2 is a top plan view of the fabric of FIG. 1.

An additional warp 12 of hydrophobic material is interlaced in the support web to define a plurality of loops 14 which extend from the top surface of the web. The loops extend along the entire top surface. Similarly, a warp 16 of hydrophilic material is interlaced in the support web to define a plurality of loops 18 which extend from the bottom surface of the web opposite the loops 14 of hydrophobic material. As shown in FIG. 2, two transition areas 19, 20 are provided along the support web in which the warps 12 and 16 are tightly woven to avoid any elongated loops. The transition areas divide the fabric into first 22, second 24 and third 26 portions. As will be developed in greater detail below, the length of the first portion is less than the length of the second and third portions, with the length of the second and third portions being equal.

Hydrophilic materials absorb fluids while hydrophobic materials repel fluids. Suitable hydrophilic materials for the warp 16 are cellulosic or cotton materials. Suitable hydrophobic materials for the warp 12 are polyester, nylon, acrylic, or microfiber. By providing different materials for the warps, a fabric for making an article such as a pot holder or mitt can be provided with surface portions having different characteristics to increase the use and versatility of the article as will be developed in greater detail below.

The surface texture of each area of the fabric is defined by the size and treatment of the loops. Referring to FIG. 1, the loops 14 of the hydrophobic material are preferably smaller than the loops 18 of the hydrophilic material. The uncut loops define a terry cloth surface. If the loops are cut, the fabric will have a velour finish which is softer than a terry finish. The cut loops or velour finish can be added to only one or both surfaces, depending on the end use desired.

Figure 3:
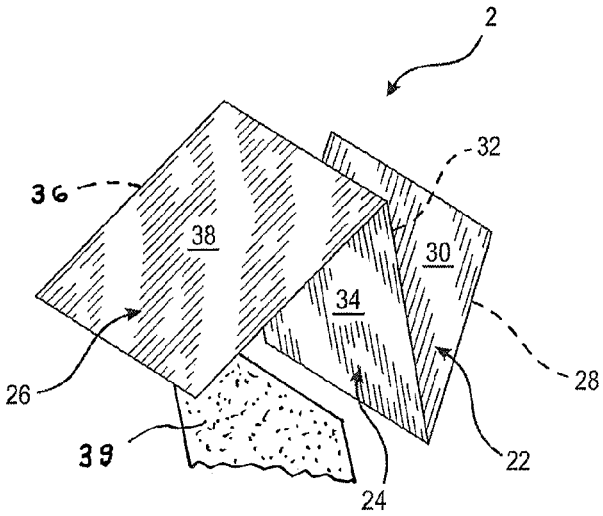
FIG. 3 is a perspective view of the fabric of FIG. 2 folded into a Z-shaped configuration.
Figure 4:
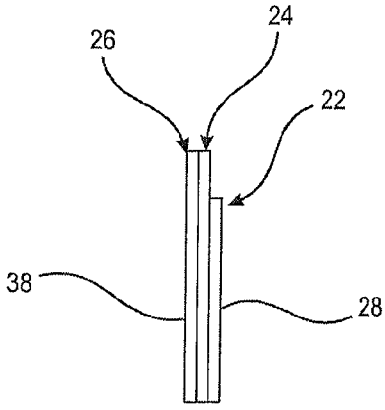
FIG. 4 is a side view of the holder/mitt after folding.

Referring now to FIG. 3, the fabric 2 is folded at the transition areas 18, 20 into a Z-shape. When completely folded, the portion 24 is sandwiched between the portions 26 and 22 with the portion 22 being shorter than the portions 24 and 26 as shown in FIG. 4. When folded as shown, the fabric first portion 22 has a first surface 28 of hydrophobic material and a second surface 30 of hydrophilic material. The second portion 24 has a third surface 32 of hydrophilic material and a fourth surface of 34 hydrophobic material, and the third portion 26 has a fifth surface 36 of hydrophobic material and a sixth surface 38 of hydrophilic material. The first and sixth surfaces define the outer surfaces of the holder/mitt with the second and third surfaces being arranged opposite one another and the fourth and fifth surfaces being arranged opposite one another.

Figure 5:
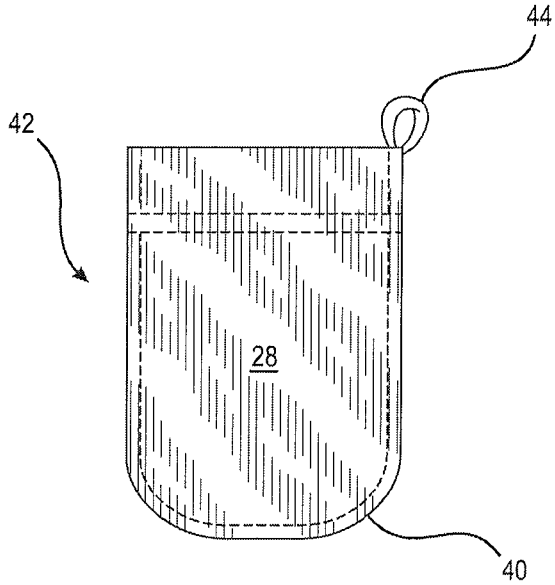
FIG. 5 is a front plan view of the holder/mitt after folding and stitching of a fabric binding.

After Z-folding the fabric as shown in FIGS. 3 and 4, the edges of the folded fabric may be trimmed if desired to provide rounded corners as shown in FIG. 5. Next, a high temperature heat activated non-woven adhesive sheet 39 is inserted between the surfaces 34 and 36 of portions 24 and 26. A fabric binding 40 is sewn down one of the sides of the pot holder 42, around the bottom and up the other side. If desired, the binding may extend beyond the other side to and then looped back and stitched to define a hanging loop 44.

Figure 6:
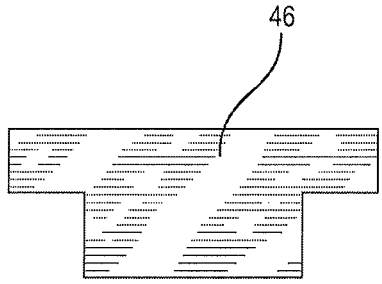
FIG. 6 is a plan view of a T-shaped insert print mask which is used during finishing of holder/mitt.
Figure 7:
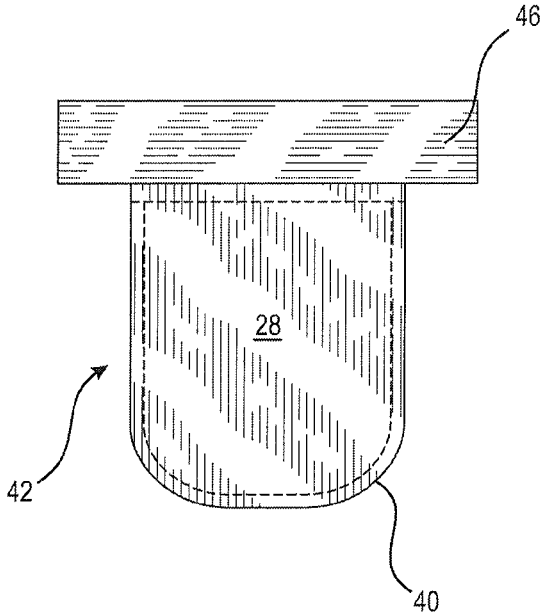
FIG. 7 is a plan view of the holder/mitt of FIG. 5 with the insert arranged therein.
Figure 8:
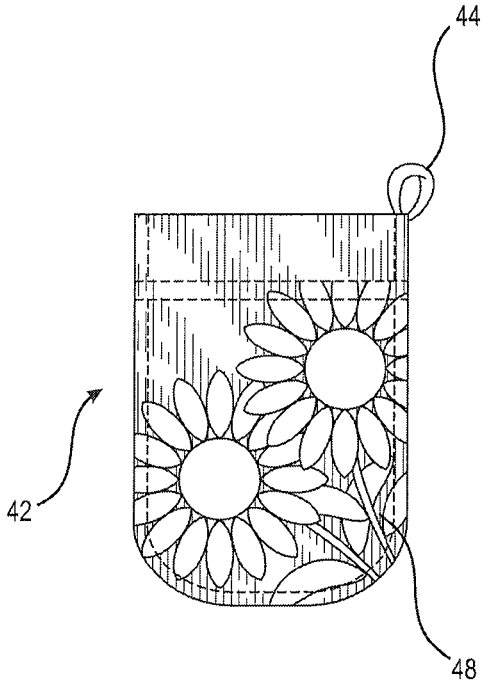
FIG. 8 is a plan view of the holder/mitt having a decorative pattern applied to the first surface thereof.

In order to complete the pot holder or mitt, the mitt is printed and pressed under heat and pressure to activate the adhesive layer and to print a decorative pattern on the first surface of the holder/mitt as shown in FIG. 8. In order to control the heat press and printing operation, a T-shaped print mask board 46 as shown in FIG. 6 is partially inserted into the pocket defined between the first and second portions of the fabric as shown in FIG. 7. The board serves as a mask for the top portion of the third surface 32 of the fabric to prevent printing thereon. A vapor transfer print sublimation paper is placed against the first surface 28, with the sublimation dye/ink side facing the surface. Next, a heat transfer press is closed about the holder/mitt to simultaneously heat the adhesive layer and transfer a decorative pattern 48 from the vapor transfer print sublimation paper to the fabric first surface 28, which surface is printed with 100% ink/dye coverage. As a result, the top of the mitt/holder is left unprinted as shown in FIG. 8 and comprises a double thickness of terry cloth since portions 24 and 26 have been joined by the adhesive.

If desired, the fabric can be overdyed with a selected color so that the hydrophilic fiber loop pile on the second and third portions are dyed into a solid color fabric. Thus, when the finished holder/mitt is printed, the top of the holder/mitt will be a solid color to coordinate with the design element printed on face 28, as well other articles in an ensemble such as a towel.

Other printing techniques may be used to form the decorative pattern on the first surface 28. These include vapor transfer dye sublimation printing, pigment dye silk screen printing, wet process fiber reactive printing, embroidery and applique. In addition, different textures for the surfaces of the fabric may be provided by modifying the length of the loops extending from opposite sides of the support web, particularly in different sections of the first, second and third portions.

While the preferred forms and embodiments of the invention have been illustrated and described, it will be apparent to those of ordinary skill in the art that various changes and modifications may be made without deviating from the inventive concepts set forth above.

What is claimed is:

1. A pot holder/mitt comprising (a) a unitary layer of fabric having a hydrophilic material on one side and a hydrophobic material on the opposite side, said layer being folded into a Z-shaped configuration to define first, second, and third portions, said first portion having a first surface of hydrophobic material and a second surface of hydrophilic material, said second portion having a third surface of hydrophilic material and a fourth surface of hydrophobic material, and said third portion having a fifth surface of hydrophobic material and a sixth surface hydrophilic material, said first and sixth surfaces defining outer surfaces of the holder/mitt, said second and third surfaces being arranged opposite one another and said fourth and fifth surfaces being arranged opposite one another, wherein said first portion of said layer of fabric is shorter than said second and third portions, whereby a portion of said third surface extends above said first surface when said fabric is folded;

(b) a connection device arranged around the perimeter of three edges of said portions for joining the edges together to define at least one pocket between said second and third surfaces and between said fourth and fifth surfaces; and (c) a layer of adhesive arranged between said fourth and fifth surfaces for joining said fourth and fifth surfaces, whereby said holder/mitt has a single pocket between said second and third surfaces.

2. A pot holder/mitt as defined in claim 1, wherein said connection device comprises a fabric binding sewn about the perimeter of the holder/mitt.

3. A pot holder/mitt as defined in claim 2, wherein said first surface bears a decorative pattern.

4. A pot holder/mitt as defined in claim 1, wherein said fabric includes a support web comprising a plurality of picks and a plurality of warps crossly wrapped around at least one of said picks, and said hydrophilic and hydrophobic materials are interlaced in said support web to define loops of hydrophilic and hydrophobic material which extend from opposite sides of said web, respectively.

5. A pot holder/mitt as defined in claim 4, wherein said hydrophobic material comprises one of a polyester, nylon, acrylic and microfiber yarn.

6. A pot holder/mitt as defined in claim 5, wherein said hydrophilic material comprises one of a cellulosic and cotton yarn.

* * * * *